US007469427B2

(12) United States Patent
Yang et al.

(10) Patent No.: US 7,469,427 B2
(45) Date of Patent: Dec. 30, 2008

(54) STRETCHABLE AND PERMEABLE NON-WOVEN PROTECTIVE GLOVES

(75) Inventors: Kaiyuan Yang, Cumming, GA (US); Jeffrey E. Fish, Dacula, GA (US); Jason A. Baker, Alpharetta, GA (US); Oomman P. Thomas, Alpharetta, GA (US); Martin Shamis, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 155 days.

(21) Appl. No.: 11/172,607

(22) Filed: Jun. 30, 2005

(65) Prior Publication Data

US 2007/0000021 A1 Jan. 4, 2007

(51) Int. Cl.
*A41D 19/00* (2006.01)

(52) U.S. Cl. ..... 2/161.6

(58) Field of Classification Search ..... 2/161.6–161.8, 2/167–169

See application file for complete search history.

(56) References Cited

U.S. PATENT DOCUMENTS 2,104,724 A * 1/1938 Bloom ..... 2/169
3,338,992 A 8/1967 Kinney
3,341,394 A 9/1967 Kinney
3,502,763 A 3/1970 Hartmann
3,542,615 A 11/1970 Dobo et al.
3,692,618 A 9/1972 Dorschner et al.
3,802,817 A 4/1974 Matsuki et al.
3,849,241 A 11/1974 Butin et al.
4,100,324 A 7/1978 Anderson et al.
4,340,563 A 7/1982 Appel et al.
4,374,888 A 2/1983 Bornslaeger
4,443,513 A 4/1984 Meitner et al.
4,652,487 A 3/1987 Morman
4,655,760 A 4/1987 Morman et al.
4,657,802 A 4/1987 Morman
4,660,228 A 4/1987 Ogawa et al.

(Continued)

FOREIGN PATENT DOCUMENTS

WO WO 9112132 A 8/1991

(Continued)

OTHER PUBLICATIONS

U.S. Appl. No. 11/118,078, filed Apr. 29, 2005.

(Continued)

*Primary Examiner*—Katherine Moran
(74) *Attorney, Agent, or Firm*—Dority & Manning, P.A.

(57) ABSTRACT

A protective glove is provided made substantially from a laminate material. The laminate material includes a plurality of elastic strands. A first nonwoven web is attached to the plurality of elastic strands so that in a relaxed state of the elastic strands and the first nonwoven web at least one wrinkle is formed in the first nonwoven web. A second nonwoven web is also provided and is attached to the plurality of elastic strands so that in a relaxed state of the elastic strands and the second nonwoven web at least one wrinkle is formed in the second nonwoven web. The elastic strands, first nonwoven web and second nonwoven web form a laminate that is stretchable and permeable to liquid. A method of manufacture of a protective glove is also provided.

14 Claims, 8 Drawing Sheets

U.S. PATENT DOCUMENTS

| | | | | |
|---|---|---|---|---|
| 4,720,415 | A | 1/1988 | Vander Wielen et al. | |
| 4,733,413 | A * | 3/1988 | Dykstra | 2/169 |
| 4,781,966 | A | 11/1988 | Taylor | |
| 4,785,479 | A * | 11/1988 | Watanabe | 2/163 |
| 4,789,699 | A | 12/1988 | Kieffer et al. | |
| 4,818,464 | A | 4/1989 | Lau | |
| 4,965,122 | A | 10/1990 | Morman | |
| 4,981,747 | A | 1/1991 | Morman | |
| 5,036,551 | A | 8/1991 | Dailey et al. | |
| 5,114,781 | A | 5/1992 | Morman | |
| 5,226,992 | A | 7/1993 | Morman | |
| 5,244,482 | A | 9/1993 | Hassenboehler, Jr. et al. | |
| 5,336,545 | A | 8/1994 | Morman | |
| 5,385,775 | A | 1/1995 | Wright | |
| 5,560,044 | A | 10/1996 | Masley | |
| 5,587,225 | A | 12/1996 | Griesbach et al. | |
| 5,861,074 | A | 1/1999 | Wu | |
| 6,772,441 | B2 | 8/2004 | Lucas, Jr. | |
| 2002/0104608 | A1 | 8/2002 | Welch et al. | |
| 2003/0050589 | A1 | 3/2003 | McDevin | |
| 2004/0005832 | A1 * | 1/2004 | Neculescu et al. | 442/149 |
| 2004/0005835 | A1 * | 1/2004 | Zhou et al. | 442/328 |
| 2004/0054341 | A1 * | 3/2004 | Kellenberger et al. | 604/368 |
| 2004/0214494 | A1 * | 10/2004 | Murphy et al. | 442/149 |
| 2006/0009104 | A1 * | 1/2006 | Schneider et al. | 442/328 |
| 2006/0143767 | A1 * | 7/2006 | Yang et al. | 2/16 |
| 2006/0228969 | A1 * | 10/2006 | Erdman | 442/328 |
| 2006/0242780 | A1 * | 11/2006 | Yang et al. | 15/227 |
| 2007/0083980 | A1 * | 4/2007 | Yang et al. | 2/167 |

FOREIGN PATENT DOCUMENTS

| | | | |
|---|---|---|---|
| WO | WO 9914044 | A1 | 3/1999 |
| WO | WO 2004034664 | A2 | 4/2004 |
| WO | WO 2004034664 | A3 | 4/2004 |

OTHER PUBLICATIONS

U.S. Appl. No. 11/011,716, filed Dec. 14, 2005.
International Search Report dated Feb. 14, 2007 for International Application No. PCT/US2006/025454 filed Jun. 29, 2006.
Search Report and Written Opinion for PCT/US2006/007151, Jun. 23, 2006.

* cited by examiner

STRETCHABLE AND PERMEABLE NON-WOVEN PROTECTIVE GLOVES

BACKGROUND

Many types and styles of protective gloves are known in the art. Depending on the type of environment, nature of work, or desired properties, these gloves are made from a variety of materials, including woven cloth fabrics, leather, natural latex or synthetic polymer elastomeric materials, or combinations of such materials.

Gloves made of woven fabrics generally allow the user's skin to breathe through the fabric such that perspiration from the hand may be wicked away by the fabric. Knit gloves are often desirable in that they allow for a relatively comfortable fit on the hand of the user. Additionally, knit gloves demonstrate at least some degree of inherent flexibility in order to accommodate movement of the user's hands. Knitting processes used to create woven knit gloves are typically slow and expensive.

Gloves that require greater protection against fluids, chemicals, or microscopic pathogens typically incorporate a barrier layer that is impervious to the undesirable substances. For example, surgical, examination, or work gloves typically are made using natural or synthetic rubber latex or other elastic polymer membranes. Unfortunately, the good barrier properties of such materials render the gloves generally non-breathable. Perspiration is trapped between the glove and the user's skin and creates a harsh an uncomfortable environment for the skin. High humidity that develops between the user's skin and the glove may have detrimental effects on skin health. Gloves of this sort may have powder disposed therein in order to help absorb moisture. In addition to becoming depleted over time, the powder may cause an allergic reaction to the skin of the user and/or may not be suitable in sensitive environments, such as an operating room or clean room.

It is generally known that certain advantages are obtained from making protective clothing articles from a laminate of a cloth-like material (i.e., a woven material) and an elastomeric or film material. The woven or other cloth-like material is typically used as an under layer and is joined with an elastomeric membrane or film as a barrier overcoat. Typically, the liners or under layers for such protective articles are generally thick, hence articles made from this type of process usually have poor flexibility and fit loosely.

The use of nonwoven materials in the construction of gloves is also known. However, previous gloves made from nonwoven materials typically do not have enough flexibility to allow for an adequate fit or lack control of surface properties such as softness, comfort, and texture, particularly on differentiation between exterior and interior surfaces. In addition, current nonwoven-based gloves are mostly fabricated together by a two-step swing and die-cutting process, which may produce relatively wide and stiff seams. For such gloves, traditionally, an inversion process is performed for inverting the glove to hide the seams. However, this results in the seams being placed against the user's skin. Additionally, the manufacturing process is labor intensive, and relatively slow and expensive. Furthermore, current nonwoven gloves often create an uncomfortable bulge in the palm area of the glove when a user closes his or her hand. This limits use of the gloves in certain applications where seamless woven knit gloves are used.

The present invention provides for an improved glove construction that incorporates nonwoven material and exhibits good flexibility to allow for a comfortable fit to the user.

DEFINITIONS

As used herein, the term "nonwoven fabric or web" means a web having a structure of individual fibers or threads which are interlaid, but not in an identifiable manner as in a knitted fabric. Nonwoven fabrics or webs have been formed from various processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein, the term "thermoplastic" means a plastic material that is fusible. The fibers in a thermoplastic material, if present, have a tendency to soften at higher temperatures.

As used herein, the term "spunbonded fibers" refers to small diameter fibers that are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the entire contents of which are incorporated herein by reference in their entirety for all purposes. Spunbond fibers are generally continuous and have diameters generally greater than about 7 microns, more particularly, between about 10 and about 20 microns. As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al., the entire contents of which are incorporated herein by reference in their entirety for all purposes. Meltblown fibers are microfibers that may be continuous or discontinuous with diameters generally less than 10 microns.

As used herein, the term "composite" refers to a material that may be a multicomponent material or a multilayer material. These materials may include, for example, stretch-bonded laminates, neck bonded laminates, or any combination thereof.

As used herein, the term "stretch-bonded laminate" refers to a composite material having at least two layers in which one layer is a gatherable layer and the other layer is an elastic layer. The layers are joined together when the elastic layer is extended from its original condition so that upon relaxing the layers, the gatherable layer is gathered. Such a multilayer composite elastic material may be stretched to the extent that the nonelastic material gathered between the bond locations allows the elastic material to elongate. One type of stretch-bonded laminate is disclosed, for example, by U.S. Pat. No. 4,720,415 to Vander Wielen et al., the entire contents of which are incorporated herein by reference in their entirety for all purposes. Other composite elastic materials are disclosed in U.S. Pat. No. 4,789,699 to Kieffer et al., U.S. Pat. No. 4,781,966 to Taylor and U.S. Pat. Nos. 4,657,802 and 4,652,487 to Morman and 4,655,760 to Morman et al., the contents of which are incorporated herein by reference in their entirety.

The term "stretch-bonded laminate" is broad enough to include a "neck bonded laminate".

As used herein, the terms "necking" or "neck stretching" interchangeably refer to a method of elongating a nonwoven fabric, generally in the machine direction, to reduce its width (cross-machine direction) in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.6 times. When relaxed, the web retracts toward, but does not return to, its original dimensions. Such a process is disclosed, for example, in U.S. Pat. No. 4,443,513 to Meitner and Notheis, U.S. Pat. Nos. 4,965,122, 4,981,747 and 5,114,781 to Morman and U.S. Pat. No. 5,244,482 to Hassenboehler Jr. et al., the entire contents of which are incorporated herein by reference in their entirety for all purposes.

As used herein, the term "reversibly necked material" refers to a material that possesses stretch and recovery characteristics formed by necking a material, then heating the necked material, and cooling the material. Such a process is disclosed in U.S. Pat. No. 4,965,122 to Morman, commonly assigned to the assignee of the present invention, the entire contents of which are incorporated by reference herein in its entirety for all purposes. As used herein, the term "neck bonded laminate" refers to a composite material having at least two layers in which one layer is a necked, non-elastic layer and the other layer is an elastic layer. The layers are joined together when the non-elastic layer is in an extended (necked) condition. Examples of neck-bonded laminates are such as those described in U.S. Pat. Nos. 5,226,992, 4,981,747, 4,965,122 and 5,336,545 to Morman, the entire contents of which are incorporated herein by reference in their entirety for all purposes.

As used herein, the term "coform" means a meltblown material to which at least one other material is added during the meltblown material formation. The meltblown material may be made of various polymers, including elastomeric polymers. Various additional materials may be added to the meltblown fibers during formation, including, for example, pulp, superabsorbent particles, cellulose or staple fibers. Coform processes are illustrated in commonly assigned U.S. Pat. No. 4,818,464 to Lau and U.S. Pat. No. 4,100,324 to Anderson et al., the entire contents of which are incorporated herein by reference in their entirety for all purposes.

As used herein, the term "ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the entire contents of which are incorporated herein by reference in their entirety for all purposes.

As used herein, the term "elastic" refers to any material, including a film, fiber, nonwoven web, or combination thereof, which upon application of a biasing force, is stretchable to a stretched, biased length which is at least about 110 percent, or one and a half times, its relaxed, unstretched length, and which will recover at least 15 percent of its elongation upon release of the stretching, biasing force.

As used herein, the term "extensible and retractable" refers to the ability of a material to extend upon stretch and retract upon release. Extensible and retractable materials are those which, upon application of a biasing force, are stretchable to a stretched, biased length and which will recover a portion, preferably at least about 15 percent, of their elongation upon release of the stretching, biasing force.

As used herein, the terms "elastomer" or "elastomeric" refer to polymeric materials that have properties of stretchability and recovery.

As used herein, the term "stretch" refers to the ability of a material to extend upon application of a biasing force. Percent stretch is the difference between the initial dimension of a material and that same dimension after the material has been stretched or extended following the application of a biasing force. Percent stretch may be expressed as [(stretched length+initial sample length)/initial sample length]×100. For example, if a material having an initial length of one (1) inch is stretched 0.50 inch, that is, to an extended length of 1.50 inches, the material can be said to have a stretch of 50 percent.

As used herein, the term "recover" or "recovery" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

SUMMARY

Various features and advantages of the invention will be set forth in part in the following description, or may be obvious from the description, or may be learned from practice of the invention.

A unique protective glove configuration is provided made substantially from a laminate material that provides desirable benefits to the glove. The laminate material includes a plurality of elastic strands, and a first nonwoven web attached to the strands in a relaxed state of the plurality of elastic strands and the first nonwoven web such that at least one wrinkle is formed in the first nonwoven web. The laminate material also includes a second nonwoven web that is attached in a similar manner to the plurality of elastic strands as the first nonwoven web.

In a particular embodiment, the laminate material is formed into a glove shape at least in part by seams formed through ultrasonic bonding. The bond seams may be flush seams having a minimum height dimension, for example less than 1 mm. Additionally, reinforcing bonds may be applied to the laminate in order to reinforce one or more of the flush seam bonds in a further exemplary embodiment.

The elastic strands are configured in order to form passages through which liquid is allowed to flow through the laminate materials. The first and second nonwoven webs are liquid permeable so as to result in a stretch-bonded laminate that is liquid permeable. The glove may be both liquid and gas (air) permeable in certain exemplary embodiments. The plurality of elastic strands is stretchable in order to impart stretchability in at least one direction of the stretch-bonded laminate.

A further exemplary embodiment exists in a glove as discussed above in which the first and second nonwoven webs are made from the same material, or have the same physical properties.

The present invention also encompasses a method of making a protective glove, such as the glove discussed above. The method includes the step of providing first and second liquid permeable stretch-bonded laminates that have an elastic layer made of a plurality of elastic strands. The elastic layer is located between gatherable layers that include a first and second nonwoven web. The method also includes a step of bonding the first and second liquid permeable stretch-bonded laminates to one another in the shape of a glove to form flush seam bonds around the glove.

After bonding, the glove may be inverted such that the bond seams are disposed on the inside of the glove. When formed with flush seam bonds, the flush seam bonds may be formed by a simultaneous cut-and-seal operation in which inverting is not used. Alternatively, inverting may be conducted even if a flush seam bond is formed.

The bonding step may be accomplished by any convention means. In a particular embodiment, ultrasonic bonding is employed. The laminate materials may be bonded and cut into the desired glove shape in a single processing step, such as an ultrasonic bonding process. In another embodiment, the materials may be cut and bonded by a conventional mold or die press process.

These and other features, aspects and advantages of the present invention will become better understood with reference to the following description and appended claims. The accompany drawings, which are incorporated in and constitute part of this specification, illustrate embodiments of the invention, and together with the description serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
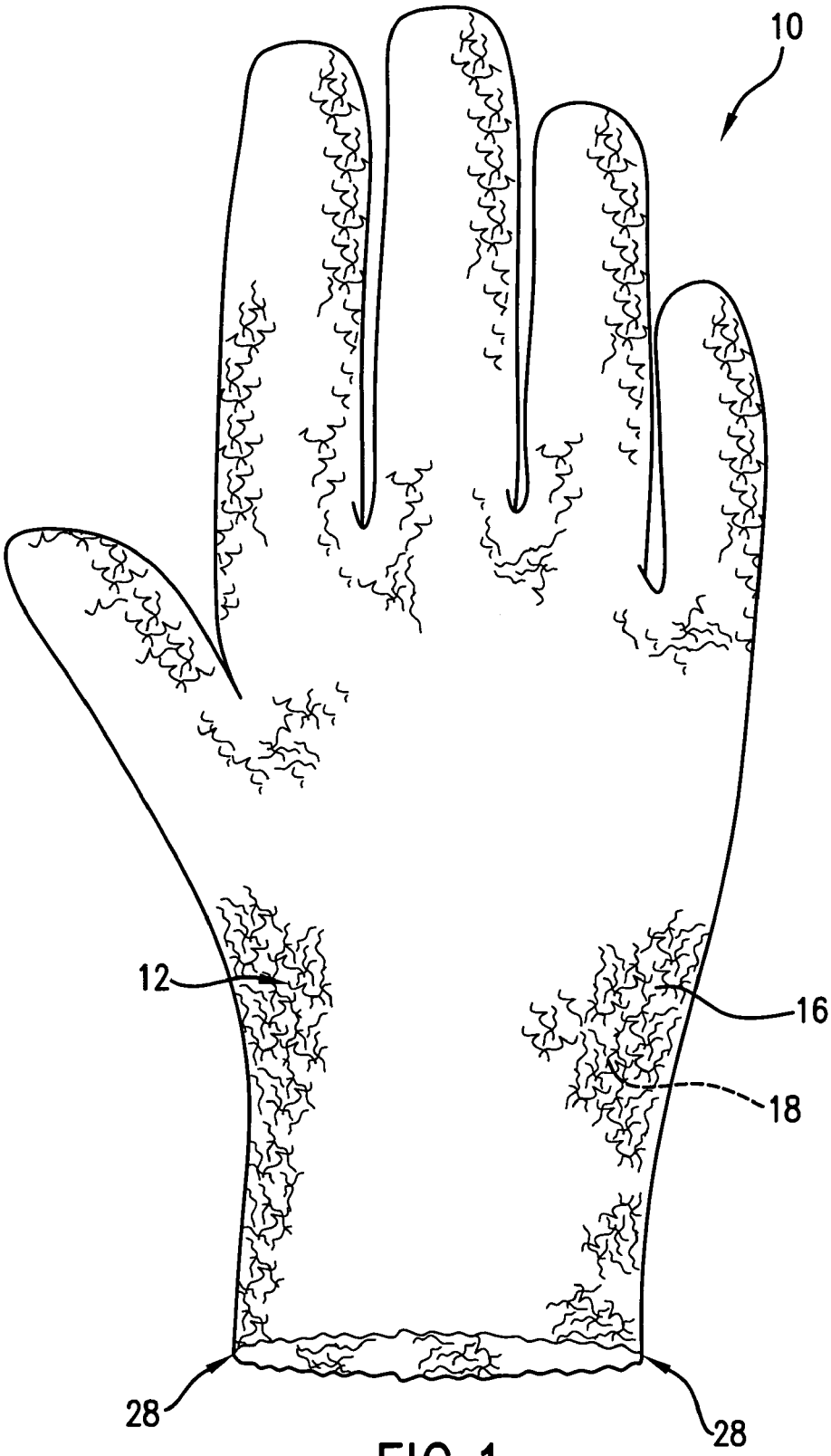
FIG. 1 is a perspective view of a protective article that is a glove in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

Referring to the figures in general, a protective glove 10 is provided having a body portion that is configured to cover the hand of a user. It should be appreciated that the glove is not limited by its intended use, and may be beneficial for use in any number of environments. The body portion of the glove 10 is made of a stretch-bonded laminate 12 that is preferably vapor permeable and is stretchable to allow for a comfortable fit and movement on the hand of the user. The body portion may also be liquid and air permeable. The glove 10 may be constructed from one or more portions that are flush seam bonded to one another. Nonwoven materials may be used in the glove 10 to provide for a knit-like glove that is of a lower cost than current knitted or woven gloves while still having desired hand-fitting properties. A glove 10 made from a nonwoven material may be desirable over regular knit woven gloves in that a nonwoven glove 10 may be made through a continuous manufacturing process and may be less expensive. The nonwoven materials may be supplied on rolls and fed into the bonding region of converting equipment to be bonded into the desired form as will be discussed. Typical knitted gloves are made one at a time in a slower process.

Figure 2:
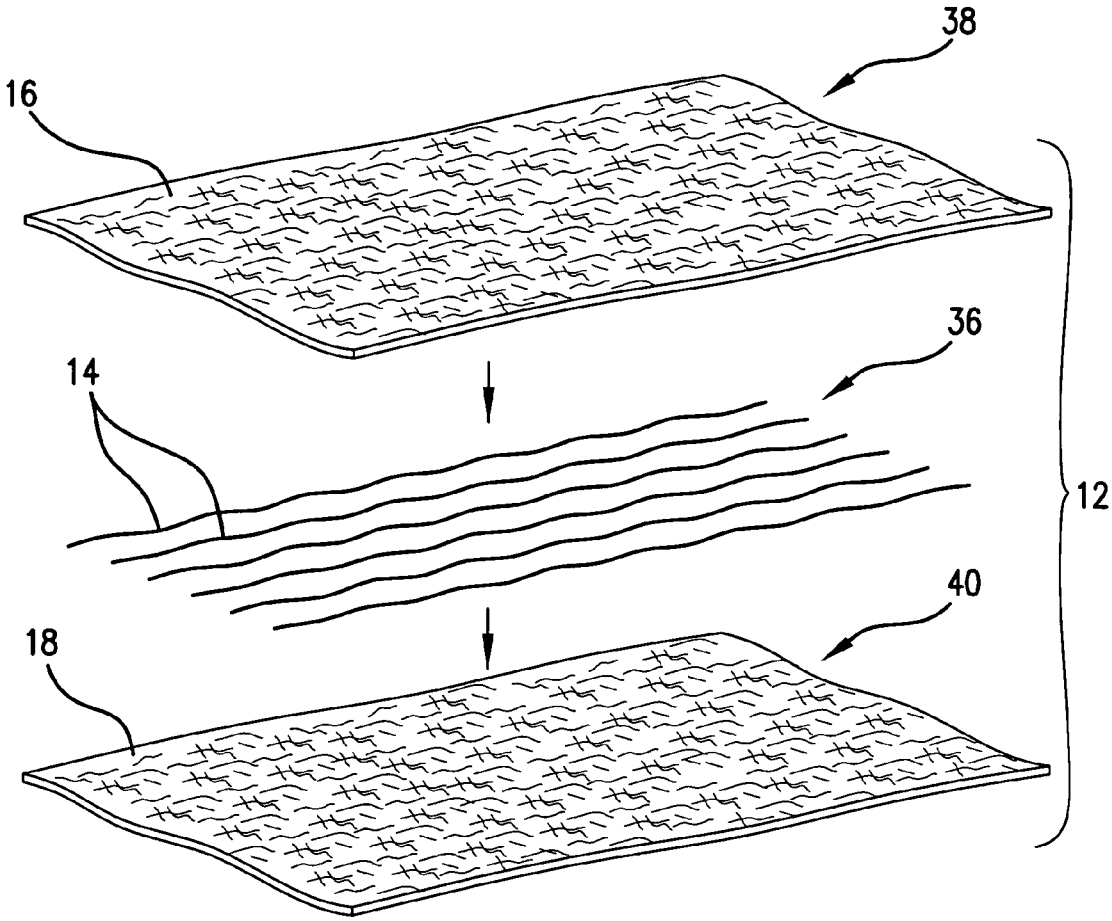
FIG. 2 is an exploded perspective view of various layers of a stretch-bonded laminate that is used to form a protective article in accordance with one exemplary embodiment.

FIG. 1 shows an exemplary embodiment of the glove 10 that may be formed from a stretch-bonded laminate 12. FIG. 2 shows various components of the stretch-bonded laminate 12 that may be used to make up the glove 10. The elastic layer 36 of the stretch-bonded laminate 12 may be made of a plurality of elastic strands 14. Any type of elastic strands 14 may be used in accordance with various exemplary embodiments. For example, the elastic strands 14 may be LYCRA® that is manufactured by E.I. DuPont of Wilmington, Delaware. Although described as being a plurality of elastic strands 14, the elastic layer 36 may incorporate other elements besides the elastic strands 14. For example, the elastic layer 36 may include a filler or binding agent that acts to hold the elastic strands 14 in relation to one another. The elastic strands 14 may be stretched and attached to one or more of the gatherable layers 38 and 40 when in the stretched condition. The gatherable layers 38 and 40 may be a first nonwoven web 16 and a second nonwoven web 18. In accordance with one exemplary embodiment, the elastic strands 14 may be stretched and then coated with gatherable layers 38 and 40 that are elastic nonwoven fibers on both sides thereof. The elastic nonwoven fibers may be KRATON® that is manufactured by KRATON Polymers of Houston, Tex. The elastic nonwoven fibers may be sprayed onto the elastic strands 14 when the elastic strands 14 are in the stretched condition. One other type of stretch-bonded laminate 12 that may be used in accordance with certain exemplary embodiments of the present invention are described, for example, in U.S. Pat. Nos. 5,385,775 and 4,720,415, and is U.S. Pat. Appln. No. 20020104608, all of which are incorporated herein by reference for all purposes.

It is to be understood, however that the gatherable layers 38 and 40 may be any type of nonwoven web in accordance with various exemplary embodiments. As shown in FIG. 2, the stretch-bonded laminate 12 is constructed so that the first nonwoven web 16 is attached to one side of the elastic strands 14 while the second nonwoven web 18 is attached to the other.

The first and second non-woven webs 16 and 18 may be flexible sheet materials that can provide desired skin-like barrier and elastic properties, while also improving the overall tactile aesthetics or feeling for the wearer, by reducing stiffness often found with nonwoven fabrics and the tackiness and difficult donning properties associated with latex-based substrates. Given the particular structure of certain nonwoven fabrics, corrugation of the contact surface helps reduce the amount of surface area that actually contacts the wear's skin, making the article 10 easier to don or doff. The physical structure of nonwoven materials also can produce capillary action to wick moisture away from the wearer's skin; hence, removing any sense of wetness or clamminess and keeping the wear feeling dry and comfortable. The wrinkles may also act to enhance air flow between the glove 10 and the skin of the user.

Figure 3:
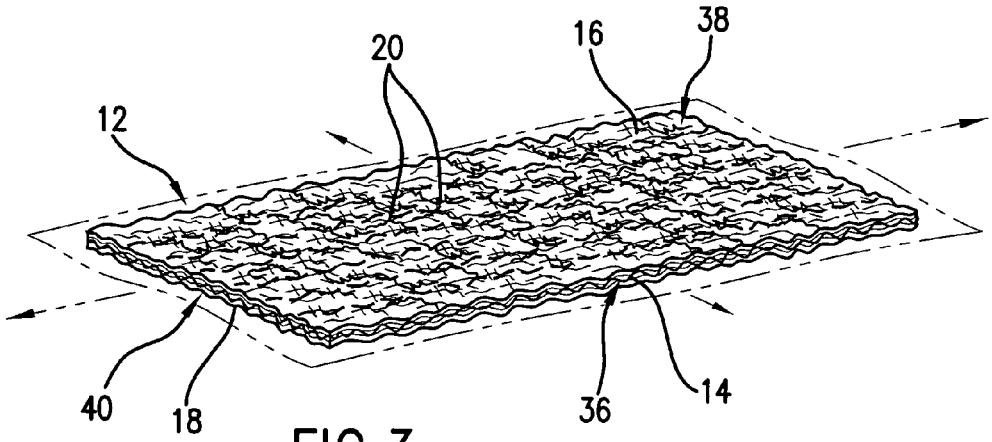
FIG. 3 is a perspective view of the layers in FIG. 2 in an assembled shape. Here, the stretch-bonded laminate has wrinkles formed in the nonwoven layers when in a relaxed state.

After attachment of the first nonwoven web 16 and/or the second nonwoven web 18 the stretch-bonded laminate 12 may be released so that the elastic strands 14 return to their normal length thus causing the first and second nonwoven web 16 and 18 to wrinkle. FIG. 3 shows the stretch-bonded laminate 12 in a relaxed position in which wrinkles 20 are formed in the first and second nonwoven web 16 and 18. The wrinkles 20 may extend through the entire nonwoven web 16 or 18 so that they are essentially on both sides of the nonwoven web 16 or 18. The stretch-bonded laminate 12 thus has a certain degree of hidden stretchability that allows for the stretch-bonded laminate 12 to function as a glove 10 or other protective article so that movement of a portion of the user's body causes a stretching in the stretch-bonded laminate 12 while still maintaining a comfortable fit onto the user. The stretch-bonded laminate 12 may fit tightly onto the skin of the user in both a relaxed state and then in a stretched state where the user moves a portion of his or her body. The glove 10 may be constructed so that a film is not present.

Figure 2A:
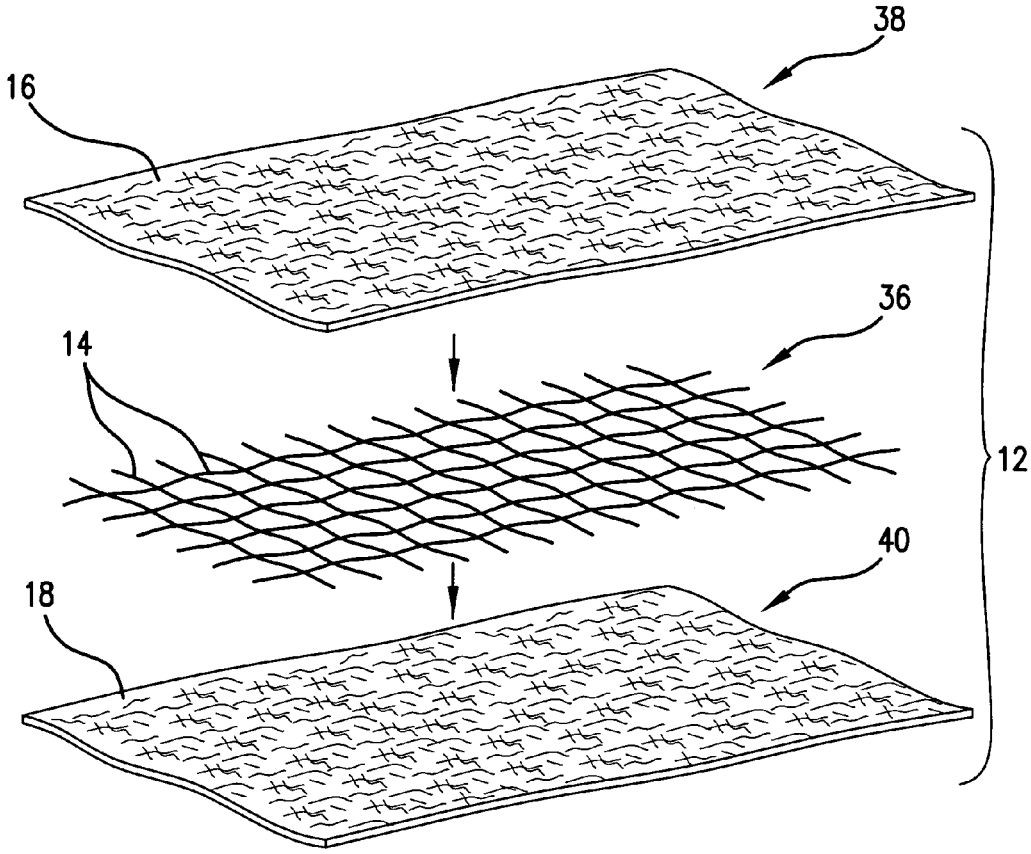
FIG. 2*a* is an exploded perspective view similar to that of FIG. 2 but with an elastic layer configured into a grid.

As shown in FIG. 2, the elastic strands 14 may be arranged so as to be parallel or formed into a grid-like or mesh type shape, as shown for instance in FIG. 2*a*. For parallel strands, the elasticity may be one dimensional, but second dimensional elasticity can come from the elastic fibers in the first and second nonwoven webs 16 and 18. If elastic fiber webs can be formed by spraying fibers in perpendicular to the parallel strands, a knit-like microstructure is formed and may be vapor or liquid permeable. The grid type of arrangement of FIG. 2*a* will allow for the stretch-bonded laminate 12 to stretch in various directions and may also incorporate additional stretching from the nonwoven webs 16 and 18. As such, the elastic strands 14 may be viewed as mesh frames that are equivalent to mesh structures formed in woven products during the knitting process but with improved surface flexibility and structural variations. However, in accordance with other exemplary embodiments the elastic strands 14 may be arranged in any desired direction so as to accommodate stretching in various directions.

Figure 4:
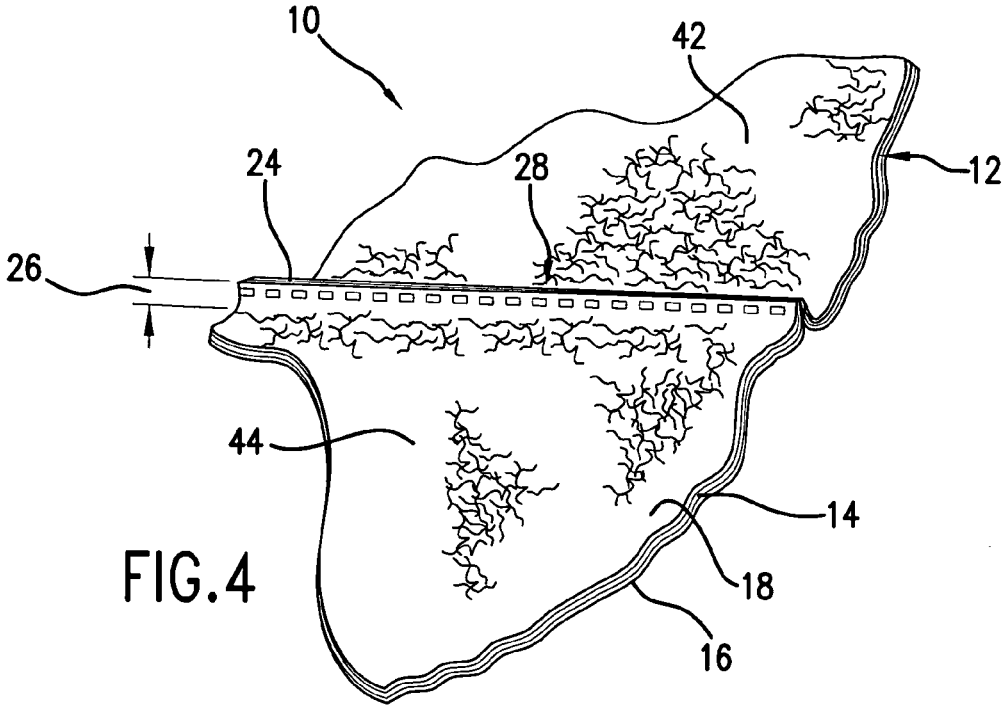
FIG. 4 is a detailed perspective view of a seam formed in a cuff area of a glove.

FIG. 4 shows a cut away portion of the inside of a glove 10 in accordance with one exemplary embodiment. Here, a first stretch-bonded laminate 42 is attached to a second stretch-bonded laminate 44 thus forming a seam 24. The seam 24 may have a height 26 that is up to 5 mm in length in accordance with certain exemplary embodiments. Alternatively, the height 26 of the seam 24 may be up to three millimeters, up to two millimeters, or less than one millimeter in accordance with certain exemplary embodiments. The height 26 of the seam 24 may impact the comfort of the user during wearing of the glove 10. For example, if the height 26 of the seam 24 is relatively large, the user will feel the seam 24 when wearing the glove 10 and may experience discomfort therefrom. Additionally, the height 26 of the seam 24 may also hinder removal of the glove 10 from the user or may interfere with donning of the glove 10. The glove 10 may be inverted in order to put the seam 24 on the inside or outside as desired.

Figure 5:
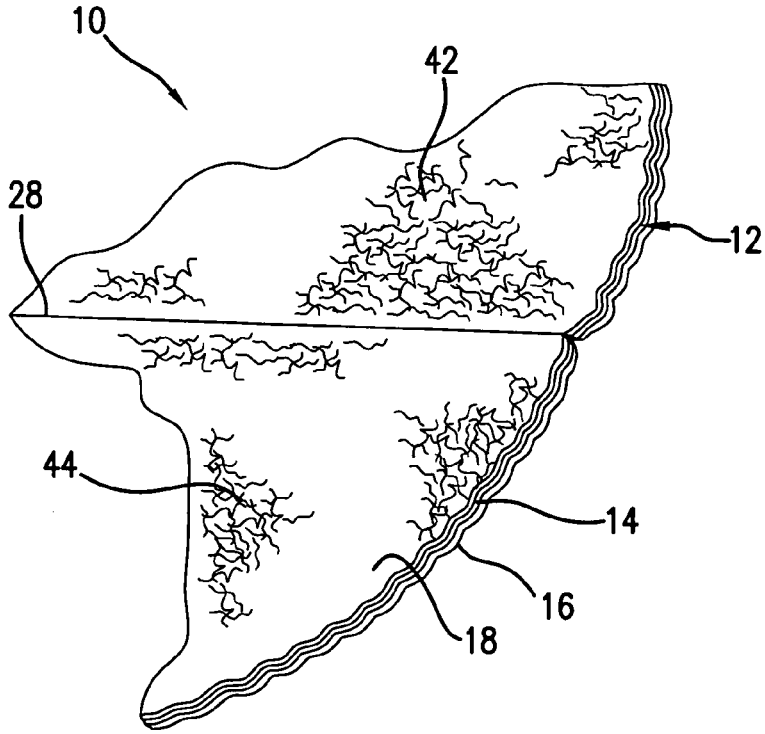
FIG. 5 is a detailed perspective view of a flush seam bond formed in a cuff area of a glove.

In accordance with one exemplary embodiment of the present invention, the first and second stretch-bonded laminates 42 and 44 may be connected to one another through one or more "flush" seam bonds 28 as shown in FIG. 5. Here, the seams are formed between the first and second stretch-bonded laminates 42 and 44 so as to have a height of generally equal to or less than 1 mm. The flush seam bond 28 allows for a greater degree of user comfort of the glove 10 as the user will not be able to feel discomfort from any seams during wearing of the glove 10. Additionally, flush seam bonding may allow for the glove 10 to be more easily donned and removed from the hand of the user as seams 24 will not be present to interfere with donning and removal. The flush seam bonds 28 may be desirable in that they result in a glove 10 that can have the same quality as woven knit gloves with respect to wearing feel and comfort. Additionally, the stretchability of the glove 10 may also provide for desired hand fitting properties and allow for easy donning and removal of the glove 10.

In a particular embodiment, the flush seam bonds 28 may be less than about 500 micrometers (μm) in width and about 500 μm in height 26. The flush seam bond 28 may also be less than 400 or 300 μm in width and 400 or 300 μm in height 26. Preferably, the flush seam bond 28 is less than 100 μm in width and 100 μm in height 26. In certain exemplary embodiments, the flush seam bond 28 width can be as narrow as about 50 μm. The width and height 26 of the flush seam bond 28 may be controlled, for instance, by varying the width and height of the glove pattern on the bonding horn or bonding anvil, or ultrasonic sewing die.

With respect to ultrasonic bonding of knit-like nonwoven gloves 10, the bonding seam 24 along the edges may have an impact for retention of the elasticity of the strands. It is conceivable that some strands may be cut loose from the seam 24 and not retain their full elasticity after a glove 10 is put on a hand under stretching. For traditional sewing manufacturing, the spacing between needle punches may not fully fix the strands into a locked position. After the sewing, the glove was cut from nonwoven sheets by a die-cutting process. This process may leave strands 14 along the cutting edges that become loose. In order to retain the elasticity of the strands 14, the inventors of the present invention believe that the seam 24 lines in knit-like nonwoven gloves 10 function as an anchor for strands 14 to prevent the strands 14 from becoming loose when the seam 24 lines are formed. In one embodiment, a seam 24 line may be formed by employing an ultrasonic glove cut/seal fixture in which a flat top is present for cutting within an angle slope for simultaneous sealing. The slope part of the fixture may only melt the nonwoven webs 16 and 18 and strands 14 so that the strands 14 will be intimately bonded together for preventing the formation of loose strands 14. Preferably, the loose strands 14 may be less than 50% after cut/seal, and in some embodiments, less than 75%, and in some embodiments, less than 85%, and in some embodiments, less than 90%.

Since gloves 10 may be in a variety of sizes and shapes, ultrasonic bonding installations, such as a plunge bonder, may not be able to place a whole hand glove facial onto a horn. For example, a glove 10 at 7×10 inches in size cannot be fabricated by a bonder that can only support a 6×9 inch horn. This is particularly true for large size gloves when the size is beyond the limit of a given ultrasonic bonder. In this case, the inventors of the present invention have discovered that it is possible to have more than one horn to make a glove 10. In some embodiments, two horns may be needed to make a glove 10. In other embodiments, four horns may be needed. Each horn can have a facial for bonding one area of the glove 10. Alternatively, the glove facial can be placed onto a large anvil and use a smaller horn to bond the glove in one or more hits.

Figure 6:
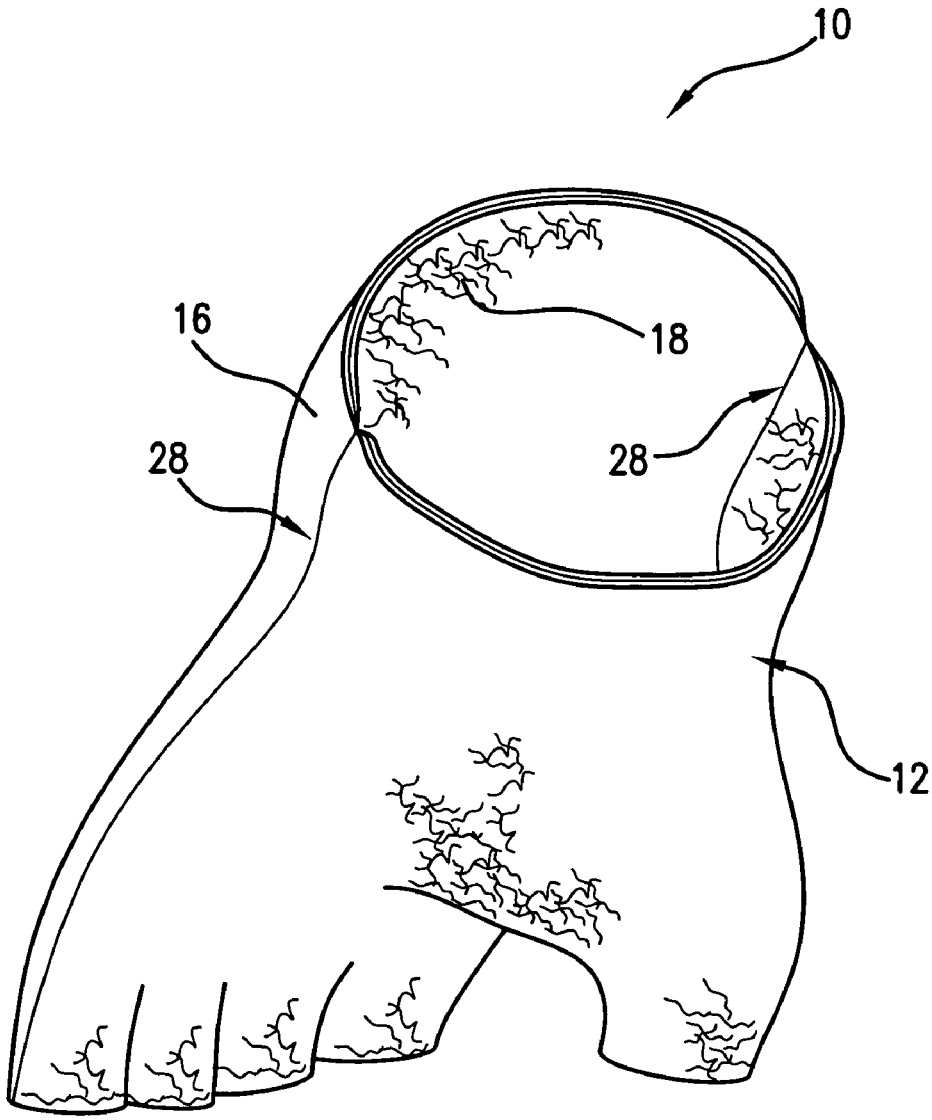
FIG. 6 is a perspective view of a protective article that is a glove in accordance with one exemplary embodiment. Here, the glove is fingerless.

It is also possible that 3D shaped gloves or other garments can be made by stretching one laminate 42 or 44 during bonding. In this case, the stretched laminate 42 or 44 retracts to its normal length and causes the glove 10 to have a 3D shape. Such a bonding process is especially useful for forming a glove that has open finger tips, as shown in FIG. 6.

It is also conceivable that a 3D shaped glove 10 can be formed by placing a first laminate 42 onto an anvil with a hand shape under vacuum. The second laminate 42 may be cut/seal bonded onto the first laminate 42 to form a 3D shaped glove 10.

Figure 1A:
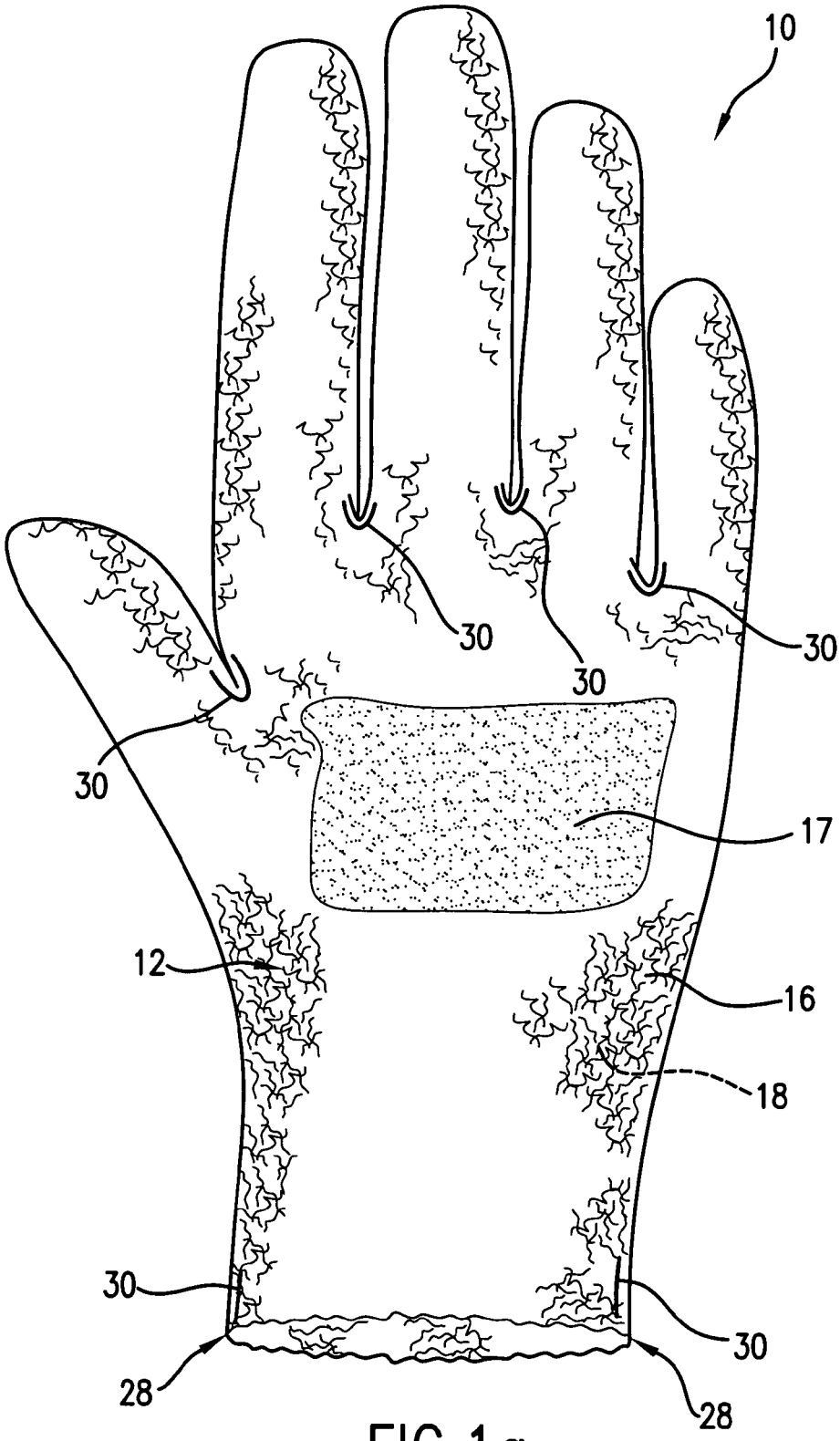
FIG. 1*a* is a perspective view of the glove of FIG. 1 with reinforcing bonds applied thereto.

Referring to FIG. 1*a,* a plurality of reinforcing bonds 30 may be applied to the glove 10 in order to reinforce the glove 10 at strategic areas. As shown in FIG. 1*a,* reinforcing bonds 30 are applied to the cuff of the glove 10 and to the areas between the fingers and thumb of the glove 10 to further reinforce the flush seam bond 28. It may be the case that the flush seam bond 28 will open to cause a separation of the first and second stretch-bonded laminates 42 and 44 of the glove 10 thus making the presence of the reinforcing bonds 30 desirable. However, it is to be understood that in accordance with other exemplary embodiments that reinforcing bonds 30 are not employed. The reinforcing bonds 30 can be made in any shape, but preferably in a shape that can help the user to place the glove 10 onto the hand.

Gloves 10 may be used as a stand-alone product or may be used as a base glove onto which a further glove is donned. Additionally, the glove 10 may be employed as an inner layer of a glove for other applications.

Figure 7:
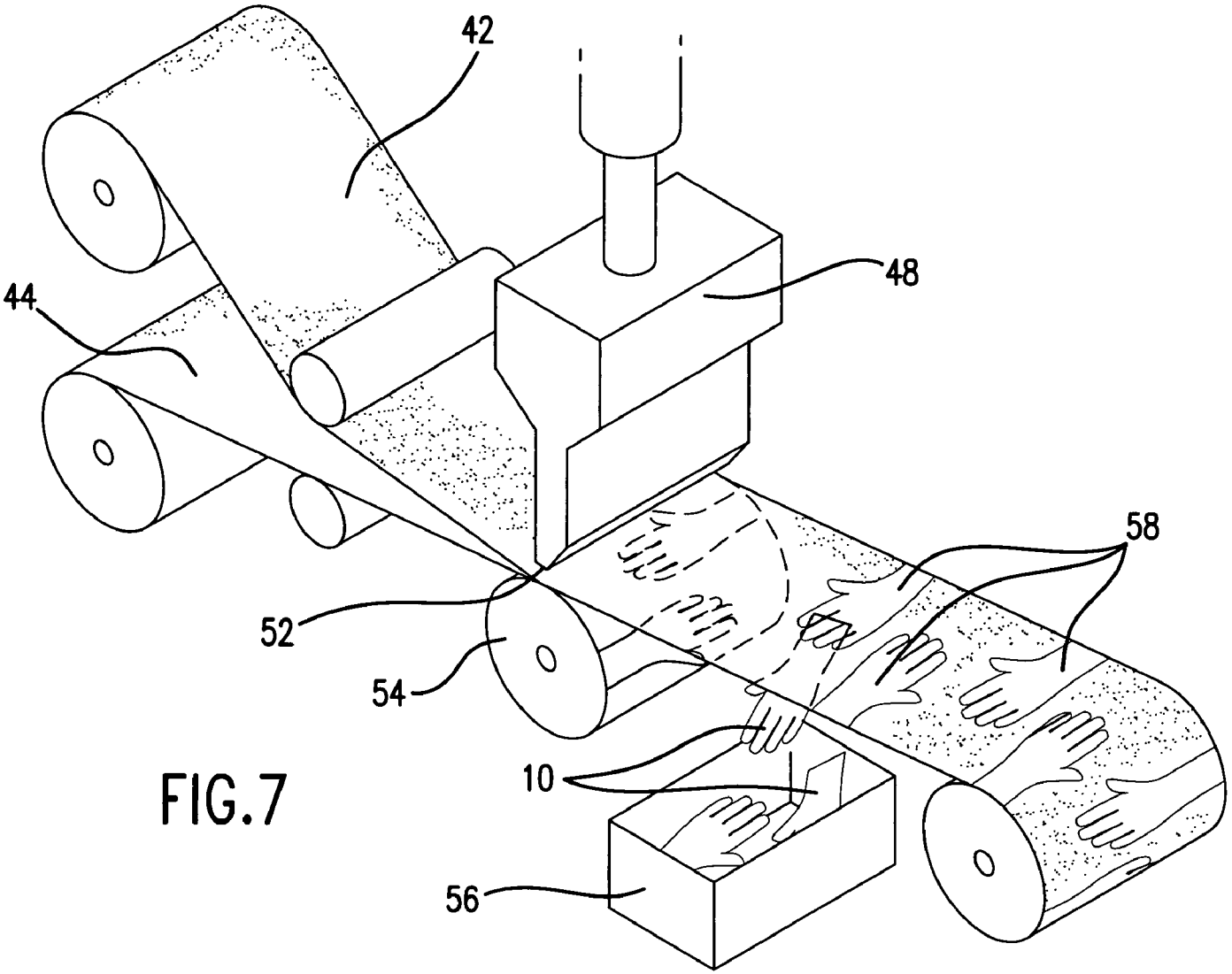
FIG. 7 is a schematic illustration of a method of manufacturing a protective article in accordance with one exemplary embodiment.

FIG. 7 shows a process of manufacturing the glove 10 in accordance with one exemplary embodiment. Here, first and second stretch bonded laminates 42 and 44 and drawn towards one another and formed into the glove 10 through an ultrasonic bonding step 48. The ultrasonic bonding step 48 and related manufacturing steps may be performed as that shown and described in U.S. application Ser. No. 11/118,078 filed Apr. 29, 2005, the entire contents of which are incorporated by reference herein in their entirety for all purposes. The ultrasonic bonding step 48 in FIG. 7 may employ a blade horn 52 positioned on one side of the first stretch-bonded laminate 42 while an anvil 54, in this case a cylinder having a pattern of gloves thereon, is located adjacent the second stretch-bonded laminate 44. The blade horn 52 may be moved into engagement with the laminates 42 and 44 to simultaneously bond and cut the laminates 42 and 44 in order to form the flush seam bond 28 thereon. The rotary anvil 54 may be configured to have an edge that is flat for cutting and an angled side for the sealing function as shown and described in the above-mentioned U.S. application Ser. No. 11/118,078.

Figure 8:
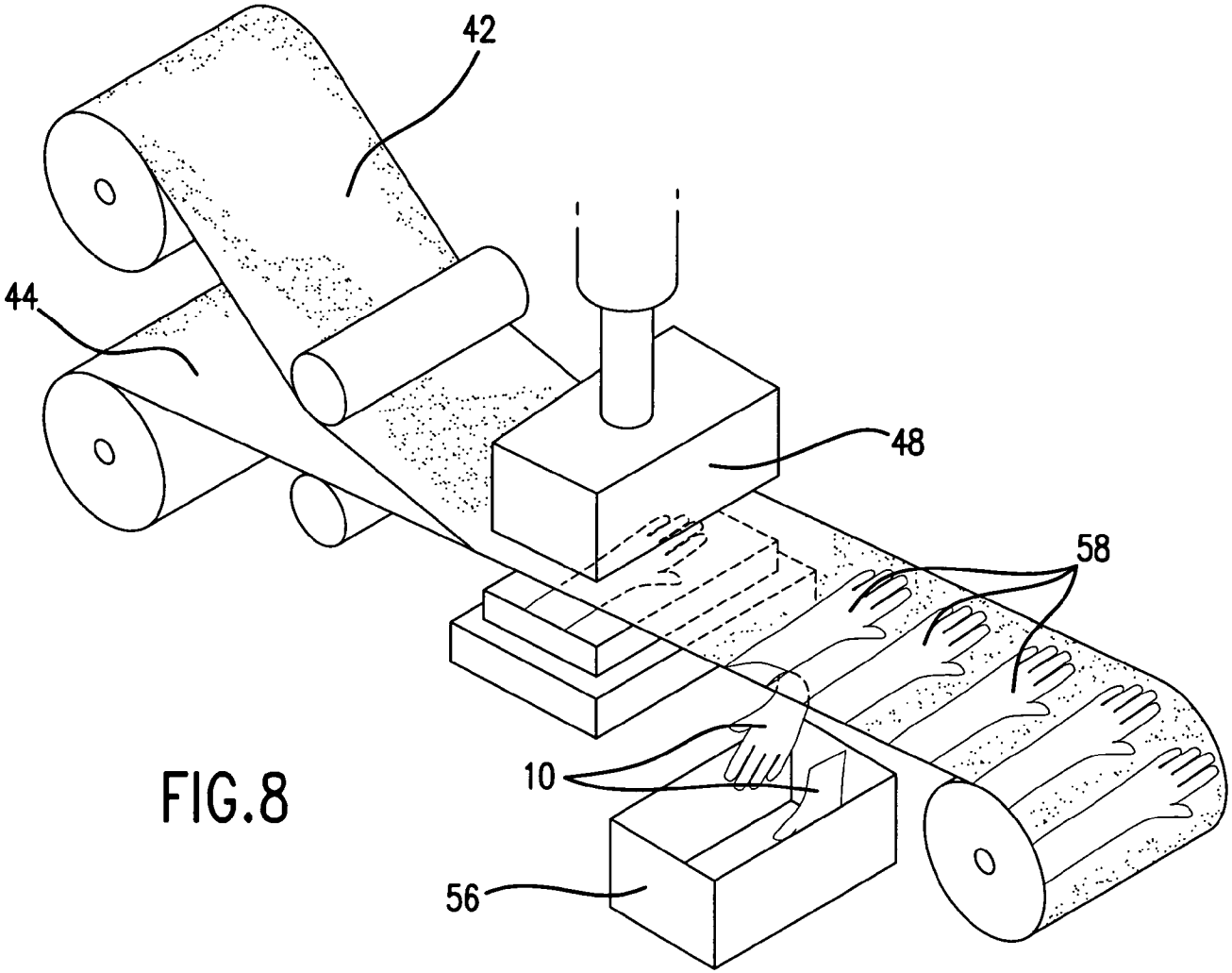
FIG. 8 is a schematic illustration of a method of manufacturing a protective article in accordance with an alternative exemplary embodiment.

The gloves 10 may be arranged so that the opening for the hand of the user is located on an edge of the laminates 42 and 44. Once formed, the gloves 10 may be removed from the laminate sheets and dropped into a collection box 56. Gloves 10 may still be in the laminate 42 and 44 in FIG. 7 immediately after the blade horn 52, but are not shown for sake of clarity. Openings 58 are made when the gloves 10 are removed. The process shown in FIG. 7 may be a continuous rotary process so that the gloves 10 may be manufactured at a high rate of speed. Alternatively, an intermittent process for the formation of the gloves 10 may also be employed, if desired, in accordance with other exemplary embodiments. FIG. 8 shows an alternative exemplary embodiment in which the gloves 10 are formed by a manufacturing process in which the bonding step 48 is an ultrasonic horn that forms the gloves 10 from laminates 42 and 44.

An inverting step may be employed to turn the glove 10 so that the flush seam bonds 28 that have any height thereto are then located on the inside of the glove 10. However, the inverting step is not necessary in accordance with other exemplary embodiments. For example, the glove 10 may be constructed and arranged so that the height of the flush seam bonds 28 are located on the outside of the glove 10. Additionally, the flush seam bonds 28 may be formed so that a height is not present. In this instance, the inverting step may not be necessary as seams will not be present on either the inside or the outside of the glove 10. By employing a bonding step 48 that creates flush seam bonds 28 the manufacturing process may be simplified as the additional inverting step may be eliminated.

A glove 10 can be generally formed in a variety of ways. For instance, in one embodiment, the glove 10 can have a unitary structure from a single piece of stretch-bonded laminate. In some embodiments, the glove 10 can be formed from multiple sections. For example, some sections may be more stretchable than others, and in some areas may be more resilient, hence stronger than others. Each section can be identical or different, depending on the desired characteristics of the glove 10.

The first and second nonwoven webs 16 and 18 may be the same or different in accordance with various exemplary embodiments. It may be desirable in some exemplary embodiments to have the inner layer of the glove 10, that may be either the first or second nonwoven web 16 or 18, made of a material that is soft as this layer will contact the skin of the user. The first and second nonwoven web 16 and 18 may be of the same or different colors in accordance with various exemplary embodiments. The use of the first or second nonwoven web 16 and 18 as the inner layer of the glove 10 may remove the need of skin protection agents, such as powder, that are present in other types of gloves. However, it is to be understood that in certain exemplary embodiments of the glove 10 that various skin protection agents such as powder may be employed if desired.

The stretch-bonded laminate 12 may be capable of stretching 200%-300%. Alternatively, the stretch-bonded laminate 12 may be capable of stretching from 50%-200% in accordance with other exemplary embodiments. Further, the stretch-bonded laminates 12 may be capable of stretching up to 400% in accordance with yet other embodiments.

The stretch-bonded laminate 12 is liquid permeable and allows for breathability of the skin of the wearer during use. The stretch-bonded laminate 12 has pores or openings that permit liquids and gasses to pass through.

The stretch-bonded laminate 12 may enable one to readily fabricate protective articles 10 using high-speed manufacturing techniques. It is believed that adaptation of a stretchable, multi-directional stretch-bonded laminate 12 for the present articles 10 can provide both the advantage of a snug fit with flexibility, and reduce the amount of material used, which can translate to an economical saving in materials of about at least 5-10%. This can enable one to produce economically disposable articles 10 for a single or limited use. The elastic nature of the stretch-bonded laminate 12 permits it to be more readily molded to conform with the three-dimensionality, for instance, of a hand in the case of a glove 10, which allows the hand to flex and move more naturally than in traditional flat-formed gloves.

All of the layers 36, 38 and 40 may be bonded together using a variety of either thermal, chemical, ultrasonic, or physical/mechanical means. Although described as having three layers 36, 38 and 40, it is to be understood that additional layers may be included in accordance with other exemplary embodiments. As such, the present invention includes exemplary embodiments in which three or more, four or more, fiver or more, or six or more layers may be incorporated into the stretch-bonded laminate 12. Desirably the article 10 forms a hollow body with an opening that fits snugly without bunching at flex points, such as along the curves of the fingers or between individual digits of a glove 10, and without either slipping or binding too tightly against, for example, either a wrist or ankle for a glove or foot cover, respectively.

In a glove 10, one of the nonwoven webs 16 or 18 may serve as either an underglove or a lining. A common problem associated with the wearing of articles or garments made from natural rubber latex over enclosed skin is the development of various skin allergies (e.g., irritant dermatitis, delayed cutaneous hypersensitivity (Type IV allergy), and immediate reaction (Type I allergy)) that are believed to be caused by proteins in the rubber latex. By using a non-woven liner, such allergy reactions can be minimized and/or eliminated by avoiding direct contact of skin with latex. Instead of being in contact with the latex rubber, the wearer's skin may touch an inner surface that has a non-woven layer of long continuous fiber strands. The non-woven liner can provide a soft cloth or "cotton-like" feel that is significantly more comfortable for the wearer than direct skin contact with latex or plastic films. A nonwoven liner also provides additional advantages over unlined or naked latex gloves by absorbing moisture, and eliminating the convention requisite for specialized donning coats. Since a nonwoven fabric typically has a lower coefficient of friction relative to plastic films or latex membranes, a glove 10 with an inner lining of nonwoven fabric can facilitate donning or doffing of the glove, permitting the user to easily slip a hand in or out of the glove. No cornstarch or talcum powder would be needed for such gloves, since the nonwoven layer is not tacky or resistant against damp human skin as rubber or other polymer latex compositions. In another concern, latex gloves are plagued by quality concerns arising from irregularities in thickness for different manufacturers. The gloves 10 of the present invention can also provide a more uniform thickness for comfort and better control, enhancing quality and reproducibility during manufacture since the nonwoven web can be prefabricated.

Various types of polymer-based materials from the art may be used to make cloth-like non-woven fabrics. A foundational substrate or base nonwoven fiber web can be formed from materials that may include, for instance, synthetic fibers, pulp fibers, thermo-mechanical pulp, or mixtures of such materials such that the web has cloth-like properties. A flexible sheet material can be used to form the non-woven webs. Nonwoven web materials suitable for use in the invention may be, for example, selected from a group consisting of spunbond, meltblown, spunbond-meltblown-spunbond laminates, coform, spunbond-film-spunbond laminates, bicomponent spunbond, bicomponent meltblown, biconstituent spunbond, biconstituent meltblown, bonded carded bicomponent web, crimped fibers airlaid and combinations thereof.

The non-woven webs 16 and 18 may include continuous fibers and can also include various elastomeric components, such as elastic laminates. For example, suitable elastic laminates can include stretch-bonded and neck-bonded laminates (or alternately a reversibly necked material in other exemplary embodiments). Alternatively, fibrous nonwoven webs formed by extrusion processes such as spunbonding and meltblowing, and by mechanical dry-forming process such as air-laying and carding, used in combination with microfiber layers, may be utilized as components. Since the materials and manufacture of these components may often be inexpensive relative to the cost of woven or knitted components, the products can be disposable.

Non-woven fabrics that may be used in the stretch-bonded laminates 12, prior to conversion into such laminates, desirably have a basis weight between about 10 $g/m^2$ and 50 $g/m^2$ and even more desirably between about 12 $g/m^2$ and 25 $g/m^2$. In an alternative embodiment such non-woven fabrics have a basis weight between about 15 $g/m^2$ and 20 $g/m^2$. Further, higher basis weights are contemplated.

Various materials that may be used to make up the elastic layer 36 and gatherable layers 38 and 40 may be found in U.S. application Ser. No. 11/011,716 entitled Breathable Protective Articles that was filed on Dec. 14, 2004. The entire contents of U.S. application Ser. No. 11/011,716 are incorporated by reference herein for all purposes. Any definitions found in the present application are given preference over those in U.S. application Ser. No. 11/011,716.

The exterior nonwoven web 16 or 18 may be a spunbond or through air bonded web made from bicomponent polyethylene/polypropylene filaments in a side-by-side arrangement. The exterior layer can have a basis weight of from about 34 $g/m^2$ to about 169 $g/m^2$, and can particularly have a basis weight of from about 68 $g/m^2$ to about 136 $g/m^2$. Alternatively, the exterior layer itself can be a layered or laminate structure. For example, a two-banked process can be used in which a layer of larger diameter fibers is formed on a layer of small diameter fibers.

The stretch-bonded laminate 12 may include elastic strands 14 made from an elastomeric material sandwiched between two polypropylene spunbond layers 16 and 18. The elastic strands 14 may be, for instance, made from a styrene-ethylene butylene-styrene copolymer, such as KRATON G2740 available from the Krayton Polymer Company. The stretch-bonded laminate 12 can have a basis weight of from about 34 $g/m^2$ to about 169 $g/m^2$, particularly from about 51 $g/m^2$ to about 85 $g/m^2$, and more particularly from about 68 $g/m^2$ to about 102 $g/m^2$.

It should be appreciated that gloves 10 according to the invention may include any combination of additional features depending on the intended use of the gloves. For example, the exterior surface of the gloves 10 may be treated or coated with a slip resistant composition that enhances the gripping ability of the glove. Referring to FIG. 1*a*, a slip resistant composition 17 has been added to the palm portion of the glove. The slip resistant composition 17 is made of nonwoven materials and/ or leather. The slip resistant composition can be applied in any desired pattern and may be applied at any suitable processing step during manufacture of the gloves 10, or after the gloves 10 have been completely formed.

Although described in terms of a glove 10 or foot covering for purposes of illustration, the present invention is not necessarily so limited. Other kinds of articles may be formed from the materials described according to the present technique and construction. These other articles may include disposable protection garments for a variety of work environments, such as, clinical or medical examination, industrial or clean room operations, and/or where characteristics such as the added strength, comfort, skin protection, and powder-free aspects of the present invention are desirable. Medically or therapeutically oriented items such as face masks, head coverings (e.g., bouffant caps, surgical caps and hoods), coveralls, lab coats, undergarments, aprons and jackets, gowns, drapes, wound dressings, bandages, sterilization wraps, cosmetic pads, patient bedding, stretcher and bassinet sheets, and the like. Additionally, the protective article 10 need not be disposable in accordance with other exemplary embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A protective glove, comprising:

a body portion formed at least in part of a laminate material, said laminate is retained into a desired glove shape at least in part by seams wherein said seams are less than 2 millimeters in height and free of stitching, said laminate material further comprising a plurality of elastic strands disposed between first and second nonwoven webs, said elastic strands attached to said nonwoven webs in a stretched condition such that in a relaxed state of said elastic strands, said first and second nonwoven webs gather and form wrinkles, and when donned by a user, said laminate material is stretchable and vapor permeable and wherein said laminate is retained into a desired glove shape at least in part by seams formed through ultrasonic bonding, the bonded seams functioning as anchors for the elastic strands.

2. The protective glove as set forth in claim 1, wherein said seams are less than one millimeter in height.

3. The protective glove as set forth in claim 2, wherein reinforcing bonds are applied to said laminate at a location so as to reinforce one or more of said seam bonds.

4. The protective glove as set forth in claim 1, wherein at least a portion of said laminate is stretchable to at least double said portion's relaxed length.

5. The protective glove as set forth in claim 1, wherein said first and second nonwoven webs are made from the same material.

6. The protective glove as set forth in claim 1, wherein said laminate is liquid permeable.

7. A glove capable of receiving a hand of a user, comprising:

a body portion formed at least in part of a stretch-bonded laminate having an elastic layer made of a plurality of elastic strands located between gathered layers of vapor permeable first and second nonwoven webs;

said elastic strands arranged so as to form passages there through such that said stretch-bonded laminate is vapor permeable; and wherein said stretch-bonded laminate is stretchable so as to impart stretchability in at least one direction of said glove body, and wherein said stretch-bonded laminate is retained into a desired glove shape by seams free of stitching that are generally less than two millimeters in height, the seams comprising ultrasonic bonds that function as anchors for the elastic strands.

8. The glove as set forth in claim 7, wherein said seams are flush seam bonds having a height of equal or less than about 1 mm and formed through ultrasonic bonding.

9. The glove as set forth in claim 7, wherein said first and second nonwoven webs have the same physical properties.

10. The glove as set forth in claim 7, wherein said stretch-bonded laminate is liquid permeable.

11. A method of making a protective glove, comprising the steps of:

providing a vapor permeable stretch-bonded laminate having an elastic layer made of a plurality of elastic strands located between gathered layers of first and second nonwoven webs;

forming the stretch-bonded laminate into a glove shape; and bonding the stretch-bonded laminate to retain the glove shape in a bonding process that forms flush seam bonds, said seam bonds are free of stitching and have a height of less than 2 millimeters and wherein said bonding step is an ultrasonic bonding process and wherein the laminate is also cut into the desired glove shape during said bonding step, the desired glove shape comprising fingers and a thumb, and wherein the seam bonds function as anchors for the elastic strands.

12. The method as set forth in claim 11, further comprising the step of inverting the bonded laminate after said bonding step such that the flush bond seams are inside of the glove.

13. The method as set forth in claim 11, further comprising the steps of applying reinforcement bonds to a cuff of said glove and to areas between the fingers and thumb of said glove.

14. The method as set forth in claim 11, wherein said step of bonding is accomplished through a die press.

* * * * *